United States Patent [19]

Boskamp

[11] Patent Number: 4,465,619

[45] Date of Patent: Aug. 14, 1984

[54] BUILT LIQUID DETERGENT COMPOSITIONS

[75] Inventor: Jelles V. Boskamp, Vlaardingen, Netherlands

[73] Assignee: Lever Brothers Company, New York, N.Y.

[21] Appl. No.: 438,669

[22] Filed: Nov. 2, 1982

[30] Foreign Application Priority Data

Nov. 13, 1981 [GB] United Kingdom ..... 8134311

[51] Int. Cl.[3] ..... C11D 1/83

[52] U.S. Cl. ..... 252/540; 252/559; 252/174.12; 252/174.17; 252/DIG. 2; 252/DIG. 12; 252/DIG. 13; 252/DIG. 14

[58] Field of Search ..... 252/173, 174.17, 174.18, 252/174.12, 540, 559, DIG. 2, DIG. 12, DIG. 13, DIG. 14, DIG. 15, 139, 158

[56] References Cited

U.S. PATENT DOCUMENTS

| | | | |
|---|---|---|---|
| 2,994,665 | 8/1961 | Reich et al. | 252/DIG. 15 |
| 3,254,028 | 5/1966 | Wixon | 252/DIG. 15 |
| 3,694,364 | 9/1972 | Edwards | 252/DIG. 15 |
| 3,741,805 | 6/1973 | Crotty et al. | 252/95 |
| 4,169,817 | 10/1979 | Weber | 252/DIG. 12 |
| 4,260,528 | 4/1981 | Fox et al. | 252/153 |

FOREIGN PATENT DOCUMENTS

| | | |
|---|---|---|
| 1357323 | 6/1974 | United Kingdom . |
| 2021142 | 11/1979 | United Kingdom . |

OTHER PUBLICATIONS

Xanthan Gum/Keltrol/Kelzan/A Natural Biopolysaccharide for Scientific Water Control, 2nd Ed., Kelco Division of Merck & Co., 1977.

*Primary Examiner*—John E. Kittle
*Assistant Examiner*—Hoa Van Le
*Attorney, Agent, or Firm*—Milton L. Honig; James J. Farrell

[57] ABSTRACT

The invention relates to aqueous, built liquid detergent compositions. The inclusion therein of a polysaccharide hydrocolloid as stabilizing agent may give rise to an unacceptable increase in viscosity or gelation. By using as detergent active material a particular mixture of an anionic and a nonionic detergent material, such increase in viscosity or such gelation is prevented. The composition is particularly suitable for inclusion therein of enzymes and an enzyme stabilizing system, such as a mixture of glycerol and sodium sulphite.

4 Claims, No Drawings

BUILT LIQUID DETERGENT COMPOSITIONS

The present invention relates to an aqueous, built liquid detergent composition having a satisfactory stability and viscosity behaviour.

Aqueous, built liquid detergent compositions are well-known in the art. They are usually based upon an aqueous system containing one or more active detergent materials and one or more builder salts. They are however not so easy to formulate, because the presence of these builder salts, particularly at higher levels, may cause stability problems, resulting in a phase-instable product, or may cause viscosity/pourability problems, resulting in a product that is too thick or not readily pourable.

There exists a vast amount of prior art dealing with these problems; one of the routes that has been proposed frequently is the inclusion in such aqueous built liquid detergent compositions of one or more stabilizing or suspending agents to impart improved storage stability to these liquid detergent compositions.

Thus, it has been proposed to include polymeric materials such as the polysaccharide hydrocolloids to stabilize aqueous built liquid detergent compositions. However, they may give rise to an unacceptable increase in viscosity due to their thickening effect. Moreover, they are sometimes incompatible with particular electrolytes at particular levels, causing an undesirable gelation effect.

We have now found that an aqueous, built liquid detergent composition with a satisfactory stability and viscosity behaviour can be obtained with the aid of polysaccharide hydrocolloids as stabilizing agent, by providing in the detergent composition a mixture of an anionic and a nonionic synthetic detergent-active material within a critical range of weight ratios. If the weight ratio between the anionic and nonionic synthetic detergent lies between 85:15 and 50:50 (based on the mixture of the anionic and the nonionic synthetic detergent), the aqueous built liquid detergent composition is satisfactorily stable at room temperature over longer periods of storage, and its viscosity at room temperature is about 1.5 Pa.s (at 21 sec.$^{-1}$ in a Haake Rotoviscometer) or less. Outside these weight ratios we have found that the viscosity increases quite dramatically, especially where there is more nonionic detergent than anionic detergent.

Consequently, according to the present invention an aqueous, built liquid detergent composition with a satisfactory stability and viscosity behaviour is provided, said composition containing an active detergent mixture and a builder salt in an aqueous medium comprising a polysaccharide hydrocolloid, the composition being characterized by the fact that it contains a mixture of an anionic and a nonionic synthetic detergent-active material in a weight ratio of 85:15 to 50:50, based on the sum of the anionic and nonionic synthetic detergent-active material. The best results are obtained if the weight ratio lies between 85:15 and 70:30.

The aqueous, built liquid detergent composition of the invention will now be further discussed in detail. The anionic synthetic detergents are synthetic detergents of the sulphate- and sulphonate-types. Examples thereof are salts (including sodium, potassium, ammonium and substituted ammonium salts such as mono-, di- and tri-ethanolamine salts) of $C_9$–$C_{20}$ alkylbenzenesulphonates, $C_8$–$C_{22}$ primary or secondary alkanesulphonates, $C_8$–$C_{24}$ olefinsulphonates, $C_8$–$C_{22}$-alkylsulphates, $C_8$–$C_{24}$ alkylpolyglycolethersulphates (containing up to 10 moles of ethylene oxide and/or propylene oxide) etc. Further examples are amply described in "Surface Active Agents and Detergents", Vol. I and II, by Schwartz, Perry and Birch.

The nonionic synthetic detergents are the condensation products of ethylene oxide and/or propylene oxide and/or butyleneoxide with $C_8$–$C_{18}$ alkylphenols, $C_8$–$C_{18}$ primary or secondary monohydric aliphatic alcohols, $C_8$–$C_{18}$ fatty acid amides, etc. Further examples are amply described in the above reference.

The total amount of anionic detergent material plus nonionic detergent material in the liquid composition generally ranges from 1–40, and preferably from 5–25% by weight of the composition.

The compositions of the invention further contain 2–60%, preferably 5–40% by weight of a suitable builder, such as sodium, potassium and ammonium or substituted ammonium pyro- and tripolyphosphates, -ethylenediamine tetraacetates, -nitrilotriacetates, -etherpolycarboxylates, -citrates, -carbonates, -orthophosphates, zeolites, carboxymethyloxysuccinate, etc. Particularly preferred are the polyphosphate builder salts, nitrilotriacetates, citrates, zeolites, and mixtures thereof.

The amount of water present in the detergent compositions of the invention varies from 5 to 70% by weight.

The polysaccharide hydrocolloid which is used in the present invention can be any hydrocolloid, derived from mono- or poly-saccharides. They are preferably prepared from gums, and they may be chemically modified, e.g. by partial acetylation, to make them more water-soluble and/or stable in the presence of the other ingredients of the composition.

Suitable examples of polysaccharide hydrocolloids are xanthan gum, guar gum, locust bean gum, tragacanth gum, and an especially suitable hydrocolloid is a partially acetylated xanthan gum, a material of which type may be obtained under the trade name of "Kelzan" from Kelco Company of N.J., U.S.A.

The polysaccharide hydrocolloid is present generally in an amount of 0.05–1.5, preferably 0.1–0.3% by weight of the final composition.

Other conventional materials may also be present in the liquid detergent compositions of the invention, for example soil-suspending agents, hydrotropes, corrosion inhibitors, dyes, perfumes, silicates, optical brighteners, suds boosters, suds depressants such as silicones, germicides, anti-tarnishing agents, opacifiers, fabric softening agents, oxygen-liberating bleaches such as hydrogen peroxides, sodium perborate or percarbonate, diperisophthalic anhydride, with or without bleach precursors, buffers, enzymers, enzyme-stabilizing and/or -activating agents, etc.

When enzymes are included in the compositions of the invention, such as proteases, amylases, cellulases, or lipases, they are usually included in an amount of from 0.001 to 10%, preferably 0.01–5% by weight of the composition. Usually also an enzyme-stabilizing system is included to achieve a satisfactory enzyme stability during storage of the final liquid composition. Typical examples of such stabilizing systems are mixtures of a polyol with boric acid or an alkalimetal borate, or a mixture of a polyol with an antioxidant, or a mixture of an alkanolamine with boric acid or an alkalimetalborate. We have found however, that if a borate is present together with a polyol, the composition can only tolerate up to about 2% of said borate, in spite of the known fact that both a polyol and a substantial level (higher than 300 ppm) of borax prevents gelation of the polysaccharide hydrocolloid.

The preferred enzyme-stabilizing system therefore does not contain more than abt. 2% of an alkalimetalborate such as borax, and the system we have found to be particularly useful is a mixture of glycerol and sodium or potassium sulphite. Other antioxidants such as pyrosulphites, bisulphites or metabisulphites can also be used instead of the sulphites. Preferably the composition of the invention contains from 1-10% of the polyol, and from 5-10% of the sulphite, The polyol is preferably glycerol, although sorbitol and mannitol, 1,2-propanediol, ethyleneglycol, glucose, fructose, lactose etc. may also be used. The term polyol does not include the polysaccharide hydrocolloids.

The enzymes can be incorporated in any suitable form, e.g. as a granulate (marumes, prills, etc.), or as a liquid concentrate. The granulate form has often advantages.

The invention will now be illustrated by way of the following examples.

EXAMPLE I

The following products were prepared:

| | Compositions Nos. 1-9 (in % by weight) |
|---|---|
| sodium dodecylbenzene sulphonate (A) | 9 |
| $C_{13}$-$C_{15}$ linear primary alcohol, (N) condensed with 7 moles of alkylene, which is a mixture of ethylene and propylene oxide in a weight ratio of 92:8. | |
| zeolite | 25.6 |
| trisodium citrate | 6.4 |
| polysaccharide hydrocolloid (Kelzan ®) | 0.15 |
| glycerol | 2.5 |
| sodium sulphite | 7.5 |
| SCMC | 0.2 |
| enzyme (Alcalase ®) | 0.7 |
| fluorescer | 0.1 |
| silicone oil | 0.3 |
| water | balance |
| weight ratio A:N: | |
| Composition No. 1 | 85:15 |
| Composition No. 2 | 78.5:21.5 |
| Composition No. 3 | 71.5:28.5 |
| Composition No. 4 | 64:36 |
| Composition No. 5 | 57:43 |
| Composition No. 6 | 50:50 |
| Composition No. 7 | 42.8:51.2 |
| Composition No. 8 | 28.5:71.5 |
| Composition No. 9 | 14:86 |

The viscosity of these products was measured after five days' storage at room temperature with a Haake Rotoviscometer at 21 $sec^{-1}$. The results were as follows:

| Composition No. | Viscosity |
|---|---|
| 1 | 1.04 Pa.s |
| 2 | 0.95 Pa.s |
| 3 | 0.78 Pa.s |
| 4 | 0.93 Pa.s |
| 5 | 0.89 Pa.s |
| 6 | 1.08 Pa.s |
| 7 | 1.28 Pa.s |
| 8 | 1.82 Pa.s |
| 9 | 2.07 Pa.s. |

These results show that if the anionic/nonionic weight ratio is less than 1, the viscosity increases dramatically, whereas if it is 1 or more, the viscosity is about 1 Pa.s or less.

EXAMPLE II

The following formulation was prepared:

| | % by weight |
|---|---|
| sodium dodecylbenzenesulphonate (A) | 7.0 |
| $C_9$-$C_{11}$ primary linear alcohol, condensed with 6 moles of ethylene oxide (N) | |
| pentasodiumtripolyphosphate | 21.0 |
| Kelzan$^R$S | 0.2 |
| glycerol | 2.5 |
| sodium sulphite | 8.0 |
| SCMC | 0.2 |
| fluorescer | 0.1 |
| silicone oil | 0.3 |
| perfume | 0.2 |
| protease (Alcalase$^R$) | 0.9 |
| water | balance. |

The A/N ratio was varied and the viscosity was measured after 4 days at room temperature. The following results were obtained:

| A/N ratio | | 90:10 | 80:20 | 70:30 | 60:40 | 20:20 |
|---|---|---|---|---|---|---|
| viscosity (Pa.s at 21 $sec.^{-1}$ | 1.55 | 0.95 | 0.55 | 1.25 | 1.7 | 2.0 |

These results show that outside the preferred weight ratio range the viscosity increased significantly. Similar data are obtained on using a $C_{13}$-$C_{15}$ primary linear alcohol, condensed with 6, 7 or 9 moles of ethylene oxide.

EXAMPLE III

The following formulations also represent the present invention:

| | a | b | c | d | e |
|---|---|---|---|---|---|
| sodiumdodecylbenzene sulphonate | 4.55 | 5 | 5 | 5 | 5 |
| $C_9$-$C_{11}$ primary, linear alcohol, condensed with 6 moles of ethyleneoxide | 1.95 | — | — | — | — |
| $C_{13}$-$C_{15}$ alcohol, condensed with 7 moles of ethylene- and propylene-oxide (weight ratio EO:PO = 92:8) | — | 2 | 2 | 2 | 2 |
| sodiumtripolyphosphate | 18.0 | — | — | | |
| glycerol | 2.5 | 7.5 | 2.5 | 5 | 2.5 |
| sodium sulphite | 7.0 | 7.5 | 8 | 8 | 7.5 |
| sodium citrate | — | — | — | 5 | — |
| zeolite | — | — | 20 | 20 | — |
| sodium nitrilotriacetate | — | 20 | — | — | — |
| sodium ethylenediamine-tetraacetate | — | — | 15 | | |
| Kelzan S | 0.22 | 0.25 | 0.25 | 0.15 | 0.2 |
| protease (Alcalase) | 0.9 | 0.9 | 0.9 | 0.9 | 0.9 |
| fluorescer | 0.1 | 0.2 | 0.1 | 0.2 | 0.1 |
| perfume | 0.25 | 0.25 | 0.25 | 0.25 | 0.25 |
| silicone oil | 0.3 | 0.3 | 0.3 | 0.3 | 0.3 |
| SCMC | 0.1 | 0.4 | 0.3 | 0.3 | 0.2 |
| water | bal. | bal. | bal. | bal. | bal. |

I claim:

1. A method for stabilizing aqueous built liquid detergent compositions comprising adding from about 0.1 to 0.3% by weight of a polysaccharide hydrocolloid selected from the group consisting of xanthan gum, guar gum, locust bean gum, tragacanth gum and derivatives thereof, to a composition comprising, in an aqueous medium, from 5 to 32% of builder salt and from 5 to 25% by weight of a mixture of an anionic and a nonionic detergent material, the weight ratio between the anionic and nonionic detergent materials lying between 85:15 and 50:50.

2. The method of claim 1 wherein the xanthan gum is a partially acetylated xanthan gum.

3. The method of claim 1 further comprising from 0.001 to 10% by weight of enzymes.

4. A method according to claim 3, further comprising 1–10% by weight of glycerol and 5–10% by weight of sodium sulphite.

* * * * *